United States Patent [19]

Kanai

[11] Patent Number: 4,964,817

[45] Date of Patent: Oct. 23, 1990

[54] CONNECTOR HOLDER

[75] Inventor: Hirosumi Kanai, Kawasaki, Japan

[73] Assignee: AMP Incorporated, Harrisburg, Pa.

[21] Appl. No.: 450,353

[22] Filed: Dec. 13, 1989

[30] Foreign Application Priority Data

Feb. 11, 1989 [JP] Japan ..... 1-14977[U]

[51] Int. Cl.[5] ..... H01R 13/436

[52] U.S. Cl. ..... 439/701

[58] Field of Search ..... 439/686, 688, 689, 695, 439/701, 709, 712, 715, 716, 724, 287

[56] References Cited

U.S. PATENT DOCUMENTS

| | | | |
|---|---|---|---|
| 2,469,397 | 11/1945 | Mezele | 439/701 |
| 3,140,139 | 11/1961 | Urban | 439/686 |
| 3,148,929 | 8/1962 | Gordon | 439/701 |
| 4,243,289 | 1/1981 | Kozel | 439/701 |
| 4,327,958 | 5/1982 | Hughes et al. | 439/701 |
| 4,596,436 | 6/1986 | Kraemer et al. | 439/701 |
| 4,820,179 | 4/1989 | Saijo | 439/682 |
| 4,881,904 | 11/1989 | Ammon et al. | 439/712 |

*Primary Examiner*—Joseph H. McGlynn
*Assistant Examiner*—Hien D. Vu

[57] ABSTRACT

An electrical connector holder (10) holds electrical connectors (20) having electrical contacts secured in dielectric housings (21) comprises a front wall (11) having apertures (17) of the same pitch as the contacts of the connectors (20), a center wall (12) extending along the length of the front wall (11), end walls (13*a*, 13*b*; 14*a*, 14*b*) at the adjacent the ends of the center wall (12) and having first latch means (15) for latchably engaging the ends of the connectors (20) when the connectors are positioned along the front and center walls between the end walls, and second latch means (16) on the center wall (12) for engaging the connectors (20) to maintain the front surfaces of the connectors against the front wall (11).

2 Claims, 2 Drawing Sheets

CONNECTOR HOLDER

FIELD OF THE INVENTION

This invention relates to an electrical connector, more specifically to an electrical connector holder to hold a pair of electrical connectors in parallel with each other.

BACKGROUND OF THE INVENTION

In a certain electro-mechanical device, it is desirable to supply two parallel independent electrical connectors each having a desired number of receptacle contacts disposed in a single row along the length of a housing at a constant pitch. Such independent connectors are electrically connected to a matable electrical connector having two rows of pin contacts disposed along the length of the housing at the corresponding pitch.

Conventionally, a box-type holder is formed by opening only at the one side plane along the rear surface from which electrical wires extend. Connectors having receptacle-type contacts are mated in parallel from the open side plane of the holder. Under this mated condition, the connectors are electrically connected by mating with a matable connector having male contacts.

It may be possible to make a single connector by integrating two connectors having female contacts in order to meet the above needs, thereby eliminating the need for the holder. However, in such a connector for making insulation-displacement connections between contacts and electrical wires, such insulation displacement connection is made either separately for each row of contacts or simultaneously for the two rows of contacts. The former process is not suited for high speed production because insulation displacement connection is repeated in two steps for first and second rows of contacts and the connector must be turned over. The latter process is not applicable to currently available automatic production machines because of its technical difficulty.

The above holder is bulky due to both sidewalls along its length. Therefore, such holder is not suitable to meet the overall compact connector design.

In addition, a connector having a relatively large number of contacts requires a relatively larger holder to mate with such connector. The larger the connector and the holder, the higher is the insertion and extraction forces therebetween, thereby requiring that they be constructed with increased holding strength. This further increases insertion and extraction resistance of the connector into and out of the holder, thus resulting in poor operability.

Another problem associated with a larger holder is increased warping of the sidewalls along its length, which results in poor operability of the connector with respect to the holder.

Therefore, there is a strong need to overcome the disadvantages of the prior art technology.

It is an object of this invention to provide an electrical connector holder to solve the above problems by forming connector-holding chambers divided by a center isolation wall to replace opposing sidewalls of the above holder and engaging means at desired locations, thereby holding an electrical connector in each chamber.

SUMMARY OF THE INVENTION

In order to solve the above problems, the connector holder in accordance with the present invention has a pair of connector-holding chambers. The chambers are constructed by an elongated front wall, a narrow center isolation wall crossing the front wall at the center portion along the length of the front wall, and end walls crossing at both ends of the center isolation wall in its width direction. The chambers are separated by the center isolation wall and open opposite to the front wall and the center isolation wall. A plurality of apertures are formed along the length of the front wall at a constant pitch through which contacts of mating connectors extend.

First and second latch means respectively are located on the end walls and the center isolation wall for engagement with the connectors to latch them in the chambers.

In a preferred embodiment, the first latch means engage ear sections on the end walls at substantially a center position along the width of the connectors to be latched in the holding chambers. The second engaging means are located on the isolation wall for engaging a rear surface of the connectors.

In greater detail, the first latch means are made of projections extending inwardly from the free ends (remote from the bases) of the end walls and extending across the center isolation wall. The second latch means are made of at least one projection on the center isolation wall at the remote edge from the front wall in an intermediate region along the length of the center isolation wall. The projection has a sloped outer surface and an inner surface essentially at a right angle to the plane of the center isolation wall.

In the connector holder according to this invention of the above construction, connectors are latchably maintained in the connector-holding chambers divided into two sections by the center isolation wall. The latchably maintained condition is further enhanced by the first latch means on the end walls and the second latch means on the center isolation wall. The two connectors thus retained by the holder are mated with a mating connector. As a result, contacts of the latter connector are electrically connected to contacts of the former connectors by way of apertures disposed in the front wall of the holder at a constant pitch.

BRIEF DESCRIPTION OF THE DRAWINGS

The present invention will be described hereunder in detail by way of example with reference to the accompanying drawings showing a preferred embodiment.

DETAILED DESCRIPTION OF THE INVENTION

Figure 1:
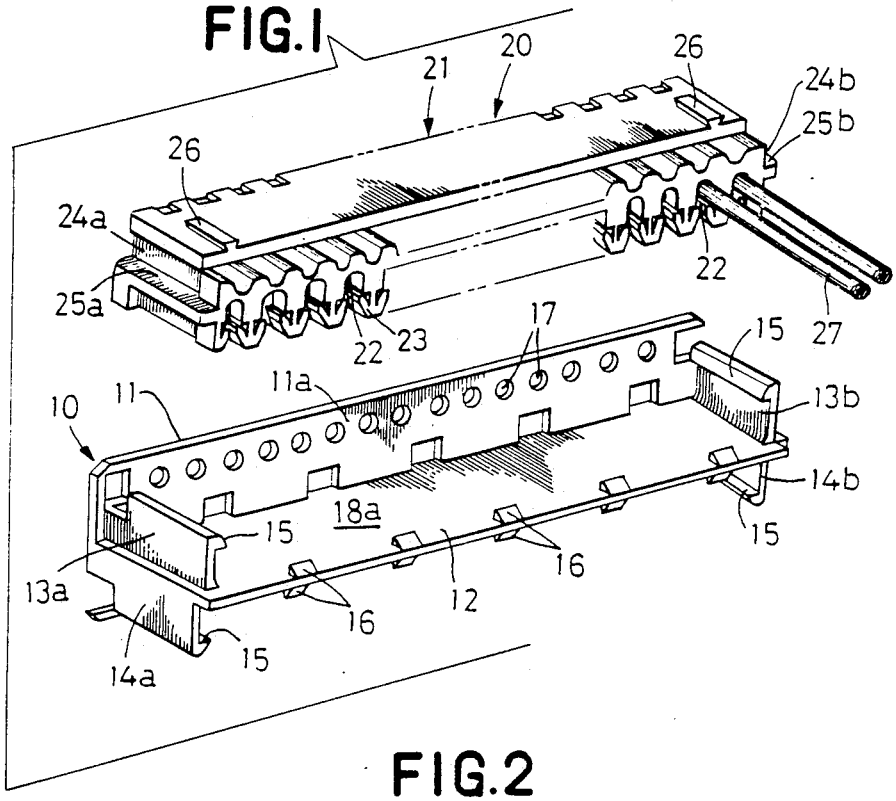
FIG. 1 is an exploded perspective view of an electrical connector holder and an electrical connector in a disassembled condition according to the present invention.
Figure 2:
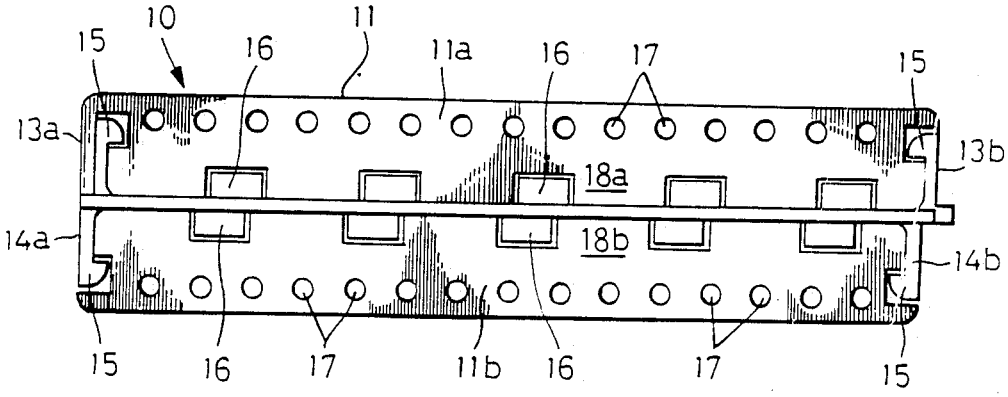
FIG. 2 is a rear elevational view of the holder in FIG. 1.

Shown in FIGS. 1 and 2 are a holder 10 and a connector 20 spaced therefrom. The holder 10 is preferably made of a flexible plastic material and comprises an elongated front wall 11 facing a mating connector (not shown), an elongated center isolation wall 12 crossing integrally at the center of the front wall 11 along the length thereof, and end walls 13*a*, 13*b*, 14*a*, 14*b* crossing at both ends of the front wall 11 and the center isolation wall 12. The height of the end walls is chosen to be slightly shorter than the height of front portions 11*a*, 11*b* on each side of the center isolation wall 12. Formed at the upper ends of the end walls 13*a*, 13*b* and the lower ends of the end walls 14*a*, 14 are a first latch means 15 extending inwardly therefrom. There are formed a second latch means 16 in the form of triangles with sloped outer surfaces at the rear end portion of the center isolation wall 12 opposite to the front wall 11 at a constant pitch along the length thereof. Apertures 17 are formed near upper and lower edge portions of the front wall 11 in correspondence with the arrangement of female contacts (not shown) secured in the connector 20 at a constant pitch. Male contacts of a mating connector extend through the apertures 17 for making electrical connection with the female contacts.

Figure 3:
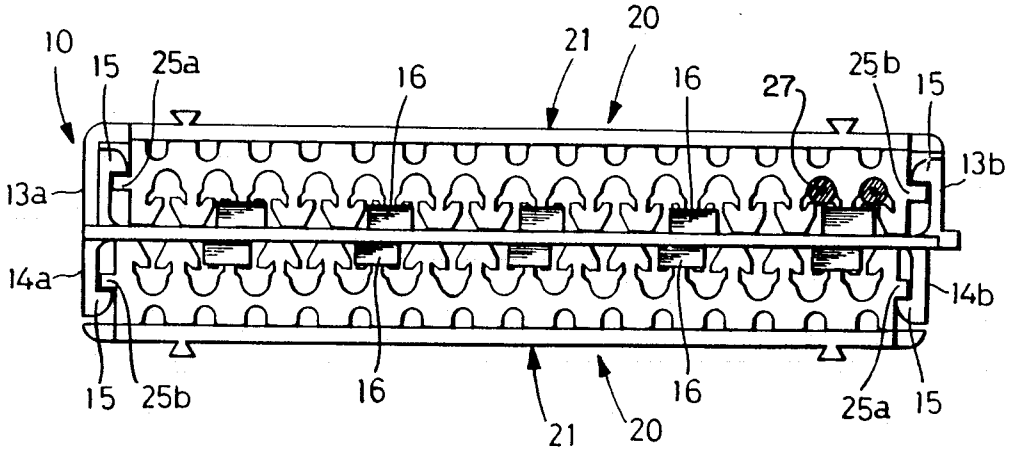
FIG. 3 is a rear elevational view of the holder with connectors latchably positioned in upper and lower chambers of the holder.

The connectors 20 include a housing 21 which are made of an insulative material such as plastic and has cavities 22 at the pitch of the female contacts. In FIG. 1, the cavities 22 are open at a rear surface and a bottom surface of the housing 21. The female-type contacts in which electrical wires 27 are insulation displacement connected are mounted into the cavities 22 from the open bottom surface and engaged by flexible engaging members 23 to prevent backward movement. There are formed on the outer surface of the end walls 24*a*, 24*b* of the housing 21 at a substantially center portion thereof, ear members 25*a*, 25*b* to engage with the first latch means 15 of the holder 10 at the inner surface. The width of the housing 21 transverse to the longitudinal direction thereof is chosen to be substantially equal to the distance between the inner surface of the front wall 11 of the holder 10 and the inner surface of the second latch means 16. The height of the housing 21 is chosen to be substantially equal to the height of the front wall 11*a*, 11*b*. There are formed projections 26 on the upper surface of the housing 21 near the both ends thereof for mating the connectors 20 with the holder 10 thereby preventing inverted mating. In this way, a pair of connectors 20 are prevented from unintentionally moving or slipping out in any direction. As understood from FIGS. 2 and 3, in the latched condition, there is no portion of the connectors 20 at upper and lower edges of the front wall 11, the upper ends of the end walls 13*a*, 13*b*, and the lower ends of the end walls 14*a*, 14*b* that extends beyond the holder 10. In order to remove the connectors 20 from the holder 10, for example, a group of the electrical wires 27 are engaged to gently pull the rear side edge of the connector 20 toward the front wall 11 with the front side edge of the connector 20 acting as a support.

As described hereinbefore, when the connectors 20 are mated with or removed from the holder 10, the end walls 13*a*, 13*b* and 14*a*, 14*b* are pressed outwardly by the ear portions 25*a*, 25*b* of the connectors against their resiliency before returning to their normal positions after mating or removal.

Since the end walls 13*a*, 13*b*, 14*a*, 14*b* of the holder 10 can be deflected outwardly as described above, the connectors 20 may be mated with the holder 10 from the rear direction. However, this operation is relatively difficult as compared with mating in a vertical direction from the upper or lower direction. It is therefore normal to mate or remove in a vertical direction. The projections 26 are provided to prevent the connectors 20 from being mated with the holder 10 in an up-side-down direction. Additionally, the second latch means 16 is most preferably formed on the center isolation wall 12 as in the shown embodiment. This is sufficient to prevent the connectors 20 from unintentionally slipping out backwardly. However, if the holder 10 and the connectors 20 are relatively short, such second latch means may be formed at appropriate locations of the end walls 13*a*, 13*b*, 14*a*, 14*b*.

According to the present invention, a center isolation wall is formed along the center of a front wall of a holder in crossing relationship therewith, the side walls of the holder facing and latchably engaging connectors positioned therein. It is, therefore, a low profile design as compared with a conventional box-type holder and economical with minimum molding material for the holder.

Despite such holder construction, when the holder is mated with two connectors, latch means are provided to firmly secure the mated connectors therein by preventing unintentional movement or slipping out of the connectors in any direction.

Also, such holder construction overcomes any disadvantages associated with the conventional elongated connector design having a large number of contacts, i.e., increased insertion and removal forces of the connectors into and out of the holder. Rather, such particular construction of the holder enhances flexibility to ease insertion and removal operations of the connectors. The center isolation wall may be relatively thin; because with the connectors mated with the holder, the center wall is strengthened.

I claim:

1. An electrical connector holder for holding electrical connectors having electrical contacts secured in dielectric housings, comprising:

a front wall;

a center wall extending along the length of said front wall;

end walls extending outwardly from each surface of said center wall adjacent each end of said center wall;

first latch means on said end walls for latchably engaging the ends of electrical connectors when the connectors are positioned along each said surface of said center wall and the front wall between the ends walls;

second latch means on said center wall for engaging the connectors to maintain the front surfaces of the connectors against the front wall; and said front wall having apertures of the same pitch as the contacts in the connectors.

2. An electrical connector holder as claimed in claim 1, wherein the second latch means are positioned along the outer edge of said center wall.

* * * * *